US010982511B2

(12) United States Patent
Provost

(10) Patent No.: US 10,982,511 B2
(45) Date of Patent: Apr. 20, 2021

(54) DOWNHOLE SYSTEM FOR GRAVEL PACKING WITHOUT A WASHPIPE

(71) Applicant: Wilfred Provost, Tomball, TX (US)

(72) Inventor: Wilfred Provost, Tomball, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 104 days.

(21) Appl. No.: 16/246,299

(22) Filed: Jan. 11, 2019

(65) Prior Publication Data

US 2020/0224516 A1 Jul. 16, 2020

(51) Int. Cl.
*E21B 43/04* (2006.01)
*E21B 34/08* (2006.01)
*E21B 43/08* (2006.01)

(52) U.S. Cl.
CPC ..... *E21B 43/04* (2013.01); *E21B 43/08* (2013.01)

(58) Field of Classification Search
None
See application file for complete search history.

(56) References Cited

U.S. PATENT DOCUMENTS 4,428,428 A * 1/1984 Smyrl ..... E21B 34/063 166/278
6,311,772 B1 * 11/2001 Myhre ..... E21B 33/124 166/278
6,371,210 B1 * 4/2002 Bode ..... E21B 43/12 166/370
6,588,507 B2 * 7/2003 Dusterhoft ..... E21B 43/04 166/278
6,675,891 B2 * 1/2004 Hailey, Jr. ..... E21B 34/06 166/228
RE45,641 E 8/2015 Henriksen et al.
9,664,007 B2 * 5/2017 Lopez ..... E21B 43/12
9,988,884 B2 6/2018 Provost
2003/0070809 A1 * 4/2003 Schultz ..... E21B 34/14 166/278
2014/0034308 A1 * 2/2014 Holderman ..... E21B 43/12 166/279
2015/0060084 A1 * 3/2015 Moen ..... E21B 43/12 166/373
2016/0215595 A1 * 7/2016 Lopez ..... E21B 34/06
2018/0283145 A1 * 10/2018 Eliseev ..... E21B 33/1285
2020/0149378 A1 * 5/2020 Van Petegem ..... E21B 43/045

* cited by examiner

*Primary Examiner* — Kipp C Wallace
(74) *Attorney, Agent, or Firm* — Cantor Colburn LLP

(57) ABSTRACT

A downhole system includes a tubular having an outer surface and an inner surface defining a conduit. A terminal member is connected to the tubular. A first screen system including a first screen housing is mounted to the tubular adjacent the terminal member, and a second screen system including a second screen housing is mounted to the tubular and spaced from the first screen system. The second screen system includes a beta blaster valve operable to selectively open flow into the conduit based on a pressure differential between the first screen system and the second screen system.

19 Claims, 6 Drawing Sheets

DOWNHOLE SYSTEM FOR GRAVEL PACKING WITHOUT A WASHPIPE

BACKGROUND

In the resource exploration and recovery industry wellbores are formed for the purpose of evaluating and extracting formation fluids from a formation. Often times, the wellbores include horizontal sections. The horizontal sections may be part of a main section of the wellbore or may take the form of branches that extend off of the main section at an angle. Generally, horizontal wellbore sections do not include a casing and thus take on an open hole configuration. A tubular that may support screens is directed into the horizontal section.

Prior to extracting formation fluids, a gravel pack operation is conducted. The gravel pack operation introduces a slurry that may include sand, drilling mud and/or other substances into the wellbore. The slurry settles between the tubular and a wall defining the formation. The slurry provides support for the wall while, at the same time, acts as a pre-filter for formation fluids passing into the tubular. The slurry is pumped into a gravel pack sleeve, and down an annulus that exists about the screens. The slurry then enters into a bottom screen joint.

An alpha wave of sand settles and forms near a heel of the wellbore and grows downward toward a toe of the wellbore. The tubular includes a washpipe that forces the slurry to travel outside of the screens. After the alpha wave reaches the toe, a beta wave forms and fills the horizontal section back toward the heel. A wellbore may require 150 joints of washpipe to support a gravel pack operation. Forming and subsequently retrieving the washpipe can take significant time. The art would appreciate a system for gravel packing an open hole that could reduce the time, expense and manpower needed to deploy and then retrieve the washpipe.

SUMMARY

Disclosed is a downhole system including a tubular having an outer surface and an inner surface defining a conduit. A terminal member is connected to the tubular. A first screen system including a first screen housing is mounted to the tubular adjacent the terminal member, and a second screen system including a second screen housing is mounted to the tubular and spaced from the first screen system. The second screen system includes a beta blaster valve operable to selectively open flow into the conduit based on a pressure differential between the first screen system and the second screen system.

Also disclosed is a method of gravel packing an open hole wellbore without a washpipe including delivering a slurry into a tubular toward a toe of the open hole wellbore, generating a beta wave of the slurry, covering a first screen system with the beta wave, and opening a beta blaster valve arranged in a second screen system in response to the first screen system being covered.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
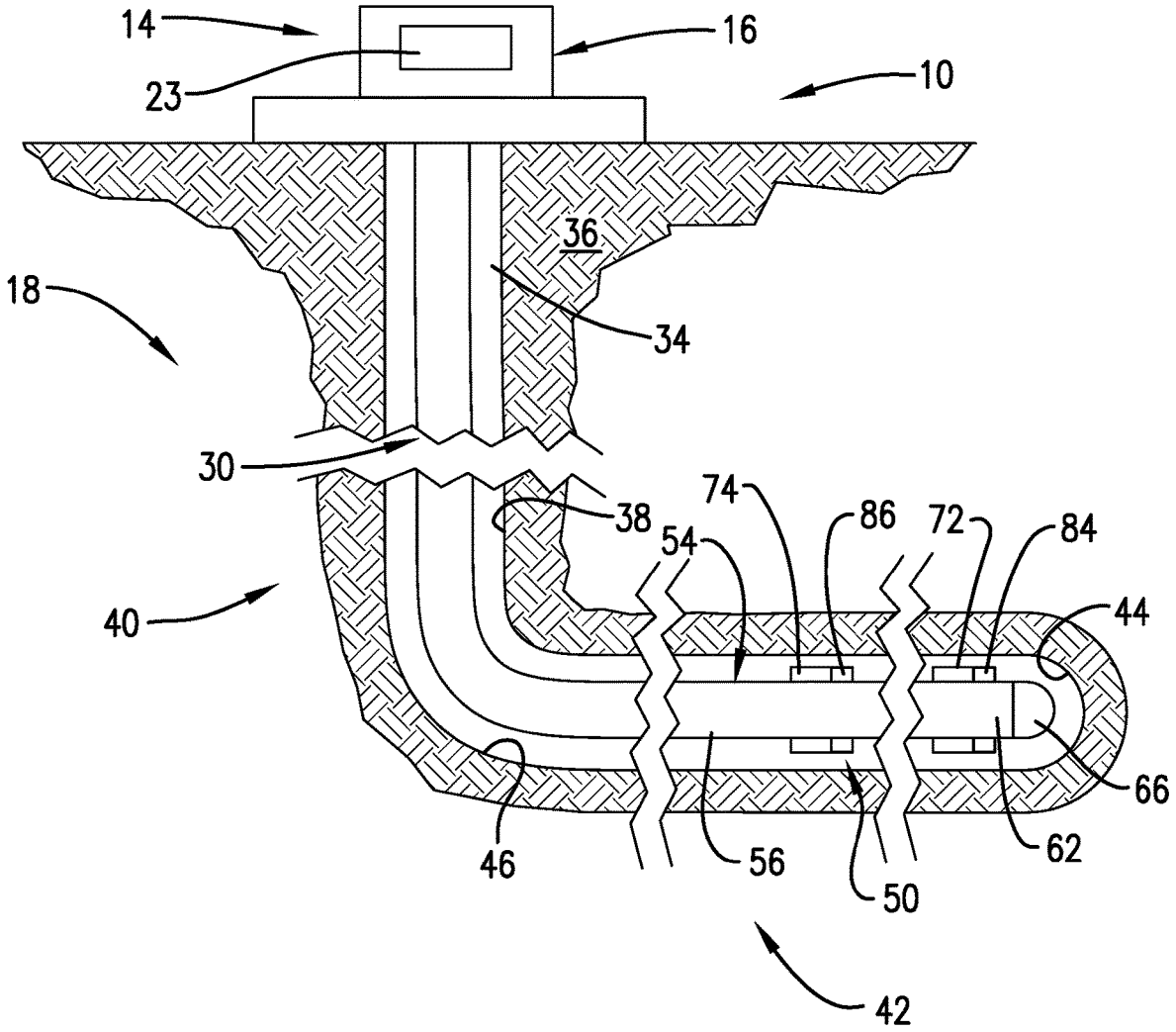
FIG. 1 depicts a a resource exploration and recovery system including a downhole tool for performing a gravel packing operation in a wellbore without a washpipe, in accordance with an aspect of an exemplary embodiment.

A resource exploration and recovery system, in accordance with an exemplary embodiment, is indicated generally at 10, in FIG. 1. Resource exploration and recovery system 10 should be understood to include well drilling operations, completions, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a downhole system.

First system 14 may include a control system 23 that may provide power to, monitor, communicate with, and/or activate one or more downhole operations as will be discussed herein. Surface system 16 may include additional systems such as pumps, fluid storage systems, cranes and the like (not shown). Second system 18 may include a tubular string 30 that extends into a wellbore 34 formed in formation 36. Wellbore 34 includes an annular wall 38 that extends along a generally vertical portion 40 to a generally horizontal portion 42 having a toe 44 and a heel 46. Tubular string 30 supports a downhole system (not separately labeled) shown as an open hole gravel pack system 50.

Figure 2:
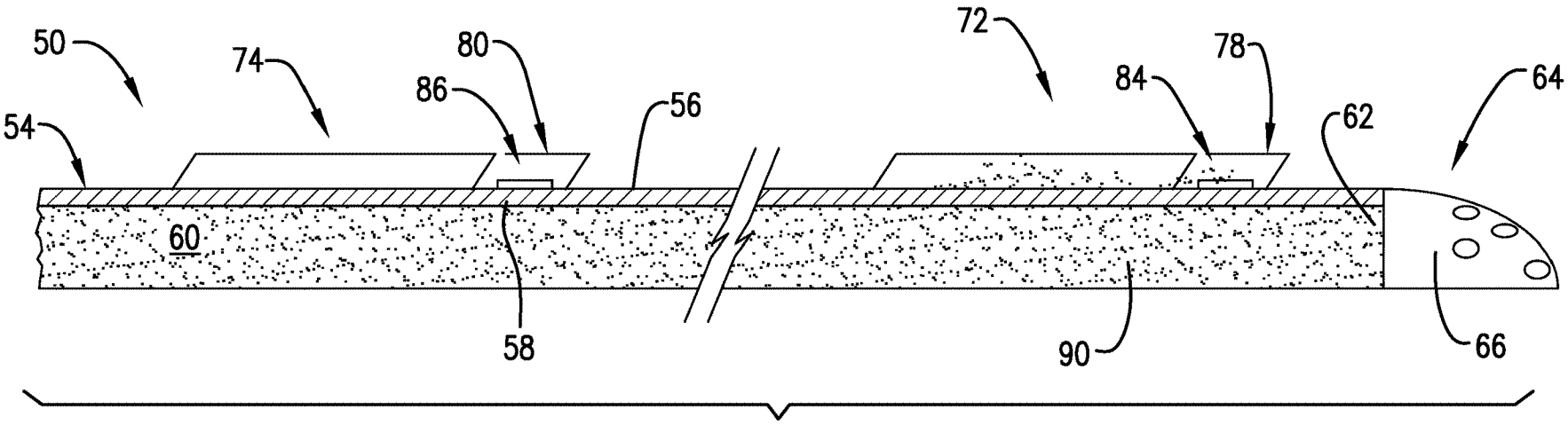
FIG. 2 depicts the downhole tool of FIG. 1 showing establishment of an alpha wave of a slurry, in accordance with an aspect of an exemplary embodiment.

Referring to FIG. 2 and with continued reference to FIG. 1, open hole gravel pack system 50 includes a tubular 54 having an outer surface 56 and an inner surface 58 that defines a conduit 60. Tubular 54 includes a terminal end 62 that supports a terminal member 64 which may take the form of a float shoe 66 arranged at toe 44 of wellbore 34. Tubular 54 supports a first screen system 72 and a second screen system 74. First screen system 72 includes a first screen housing 78 arranged near terminal end 62. Second screen system 74 is arranged uphole relative to first screen system 72 and includes a second screen housing 80.

First screen housing 78 supports a check valve 84 and second screen housing 80 supports a beta blaster valve 86. It is to be understood that the phrase "beta blaster valve" is meant to describe a valve that is responsive to a beta wave of slurry forming in wellbore 34. As will become apparent herein, in accordance with an exemplary embodiment, open hole gravel pack system 50 is devoid of a washpipe. It should be understood that check valve 84 may take on various forms.

Reference will now follow to FIGS. 2-6 in describing an open hole gravel packing process using open hole gravel packing system 50 in accordance with an exemplary aspect. As shown in FIG. 2, a slurry 90 is introduced into an annulus (not separately label) between tubular 54 and annular wall 38. Slurry 90 may be introduced into the annulus at surface system 16 or may pass through a tool (not shown) that forms part of tubular string 30 into the annulus. Slurry 90 includes fluid and particulate such as sand. Slurry 90 progresses downhole as an alpha wave. The fluid and a portion of the particulate may pass into conduit 60 through check valve 84.

Figure 3:
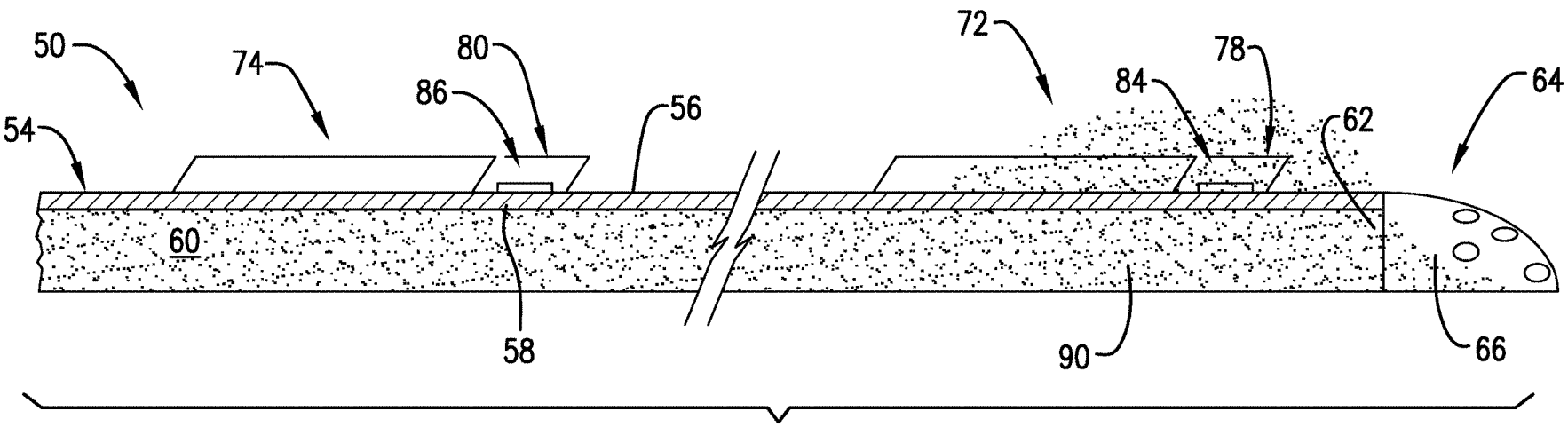
FIG. 3 depicts the downhole tool of FIG. 2 showing the slurry beginning to form at a toe of the wellbore, in accordance with an aspect of an exemplary embodiment.
Figure 4:
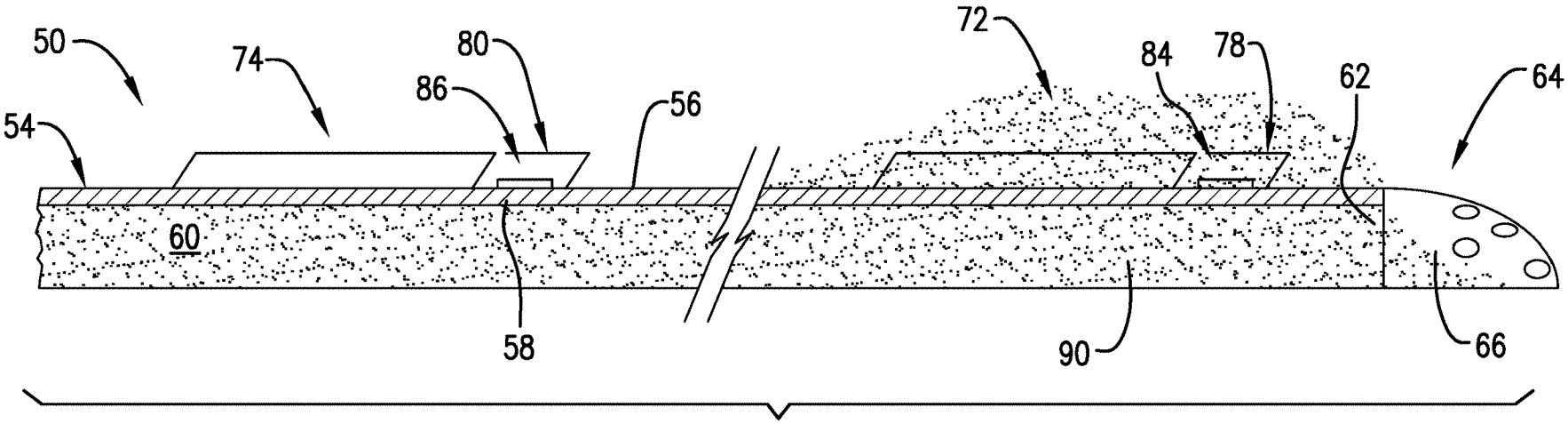
FIG. 4 depicts the downhole tool of FIG. 3 showing formation of a beta wave of the slurry, in accordance with an aspect of an exemplary embodiment.
Figure 5:
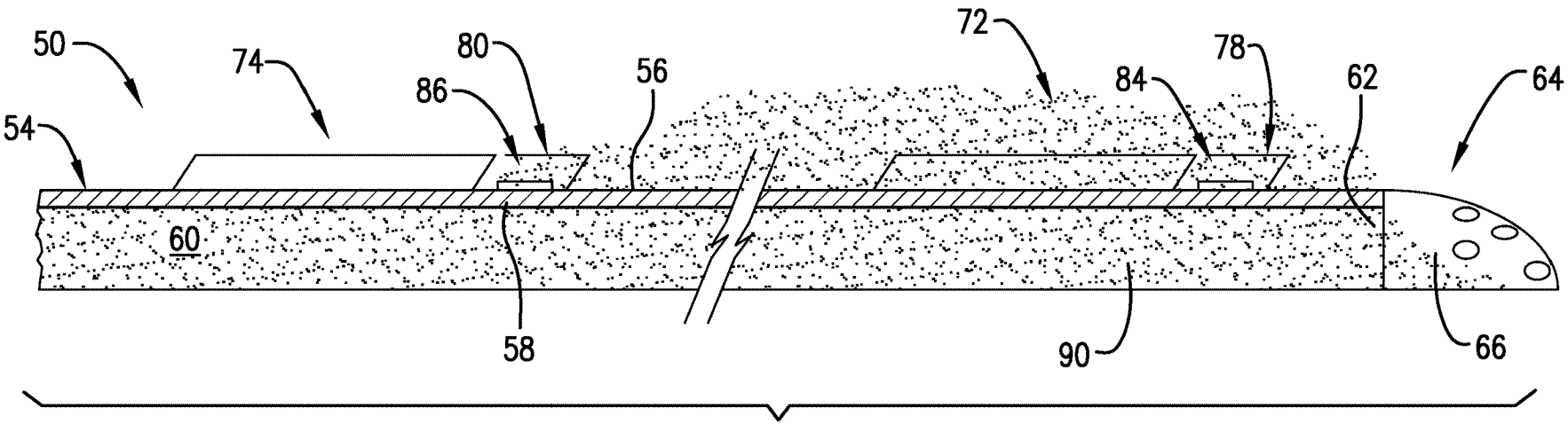
FIG. 5 depicts the downhole tool of FIG. 4 showing the beta wave covering a first screen system, in accordance with an aspect of an exemplary embodiment.
Figure 6:
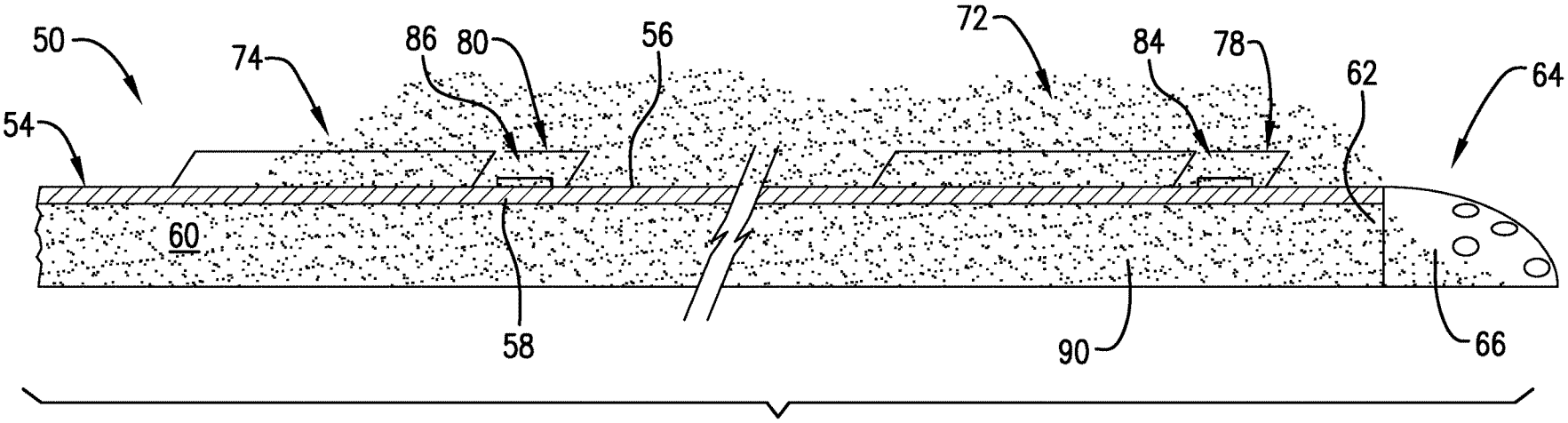
FIG. 6 depicts the downhole tool of FIG> 5 after a beta blaster valve in a second screen system opens in response the beta wave covering the first screen system, in accordance with an aspect of an exemplary embodiment.

Over time, the slurry begins to accumulate at toe 44 and a beta wave forms such as shown in FIG. 3, The beta wave begins to build an amount of slurry that grows in an uphole direction. As shown in FIG. 4, the beta wave builds increasing a thickness or height of slurry 90. The beta wave builds slurry 90 towards second screen system 74 as shown in FIG. 5. As beta wave builds slurry 90 over second screen system 74 a pressure differential develops at beta blaster valve 86.

That is, pressure below second screen system 74 drops as slurry 90 builds and pressure above second screen system 74 builds with the beta wave. This pressure differential causes beta blaster valve to open allowing fluid from slurry 90 to pass back into conduit 60. By selectively diverting fluid into conduit 60 pressure in the annulus can be maintained below selected levels. Further, as will be detailed herein, the pressure differential necessary to open beta blaster valve 86 may be controlled in order to achieve one or more selected gravel pack parameters.

Figure 7:
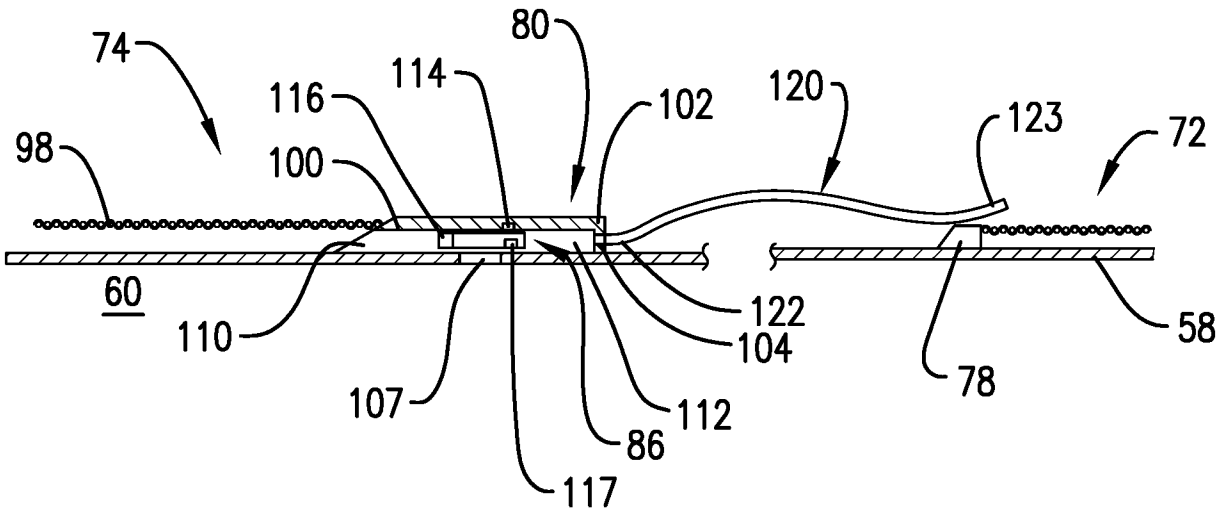
FIG. 7 depicts a partial cross-sectional view of the downhole tool of FIG. 1 showing a beta blaster valve, in accordance with an aspect of an exemplary embodiment.

Reference will now follow to FIG. 7 in describing beta blaster valve 86 in accordance with an exemplary aspect. Second screen housing 80 includes a screen portion 98 that may pass formation fluids, slurry and the like, and a valve portion 100 that houses beta blaster valve 86. Valve portion 100 includes an axial end 102 having an opening 104 that may be open to the annulus between tubular 54 and annular wall 38. A valve opening 107 extends through tubular 54 in valve portion 100.

In an embodiment, beta blaster valve 86 separates second screen housing 80 into a first volume 110 and a second volume 112. Valve portion 100 also includes a latch member 114 that may selectively retain beta blaster valve 86 in a closed configuration or an open configuration. Also, beta blaster valve 86 may include first and second seals 116 and 117 that substantially fluidically isolate first volume 110 and second volume 112.

In an embodiment, a duct 120 extends from valve portion 100 toward first screen system 72. Duct 120 includes a first end 122 that extends into opening 104 and is fluidically connected to second volume 112 and a second end 123 that may be arranged at first screen system 72. Duct 120 may be secured to tubular 54 through a variety of methods. Duct 120 provides fluidic communication from the annulus to second volume 112.

Once second end 123 is covered with slurry 90, a selected pressure differential may develop between first volume 110 and second volume 112 that causes beta blaster valve 86 to transition to an open configuration. The particular position of second end 123 may dictate at what level of slurry 90 the selected pressure differential may be achieved. At this point, it should be understood that while shown as a flexible member, duct 120 may be formed by positioning a shroud (not shown) between second screen system 74 and first screen system 72. The shroud may establish one or more axially flow passages that might establish the selected pressure differential.

Figure 8:
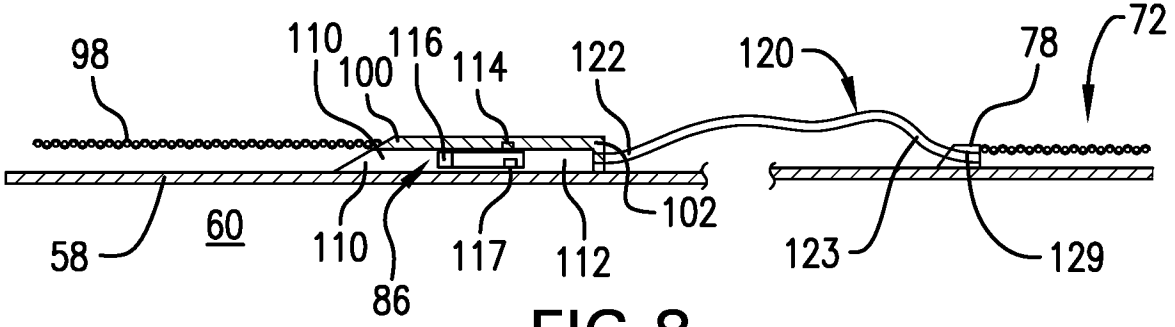
FIG. 8 depicts a partial cross-sectional view of the downhole tool of FIG. 1 showing a beta blaster valve, in accordance with another aspect of an exemplary embodiment.
Figure 9:
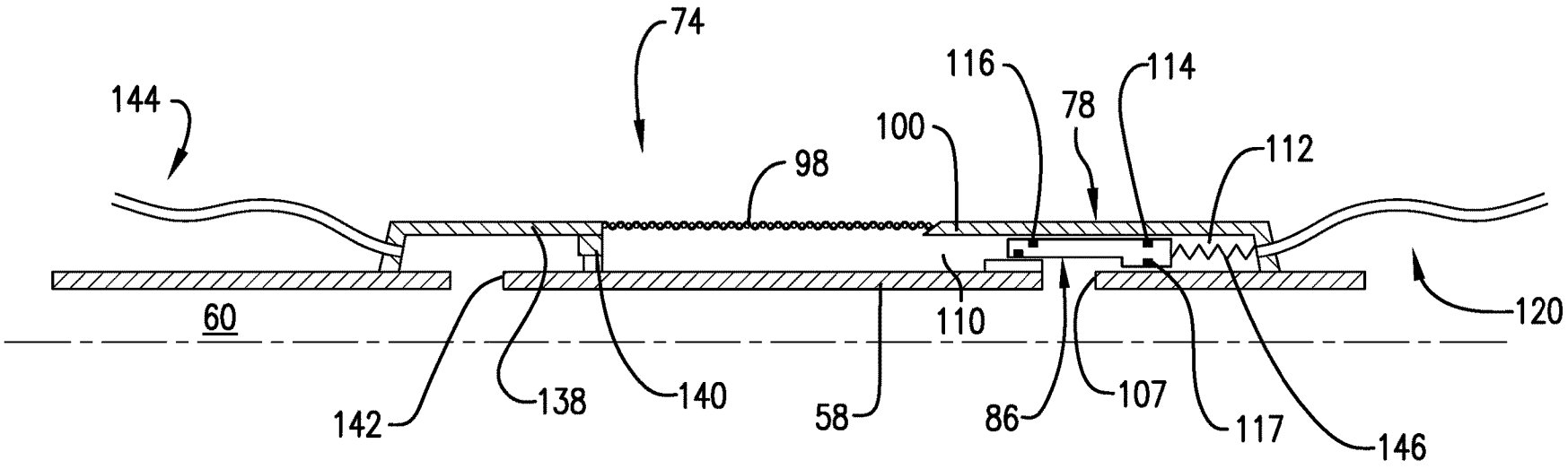
FIG. 9 depicts a partial cross-sectional view of the downhole tool of FIG. 1 showing a beta blaster valve, in accordance with yet another aspect of an exemplary embodiment.

Reference will now follow to FIG. 8, wherein like reference numbers represent corresponding parts in the respective views. As shown in FIG. 8, second end 123 of duct 120 is arranged in a passage 129 that directly fluidically connects second volume 112 and first screen housing 78. FIG. 9, depicts second screen housing 80 including an inflow control device (ICD) portion 138 that includes an ICD 140 that selectively fluidically exposes an inflow opening 142 to first volume 110. That is, after gravel packing and closing beta blaster valve 86 ICD 140 may be opened to permit formation fluids to pass into conduit 60. FIG. 9 also depicts another duct 144 extending from second screen housing 80 in an uphole direction towards another screen housing (not shown). In the embodiment shown, a biasing member 146 may urge beta blaster valve 86 towards a closed configuration. In this manner, formation fluids will pass through inflow opening 142 and not opening 104 during production.

Figure 10:
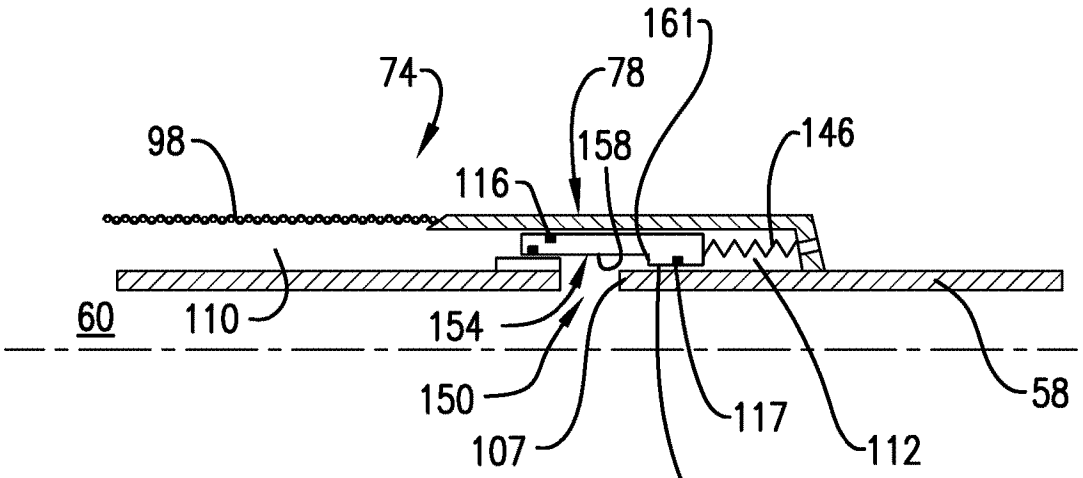
FIG. 10 depicts a partial cross-sectional view of the downhole tool of FIG. 1 showing a beta blaster valve, in accordance with still yet another aspect of an exemplary embodiment.

In FIG. 10, a beta blaster valve 150 is shown to include a radially inwardly facing surface 154 having an actuator feature 158 including an actuator surface 161. With this arrangement, in addition to a pressure differential between first volume 110 and second volume 112 operating beta blaster valve 150, a pressure from within conduit 60 passing through opening 107 may act on actuator surface 161 causing beta blaster valve 150 to shift to an open configuration. Biasing member 146 may then Shift beta blaster valve 150 back towards a closed configuration.

Set forth below are some embodiments of the foregoing disclosure:

Embodiment 1

A downhole system comprising: a tubular including an outer surface and an inner surface defining a conduit; terminal member connected to the tubular; a first screen system including a first screen housing mounted to the tubular adjacent the terminal member; and a second screen system including a second screen housing mounted to the tubular and spaced from the first screen system, the second screen system including a beta blaster valve operable to selectively open flow into the conduit based on a pressure differential between the first screen system and the second screen system.

Embodiment 2

The downhole system according to any previous embodiment, further comprising: a check valve arranged in the first screen housing between the first screen system and the terminal member.

Embodiment 3

The downhole system according to according to any previous embodiment, wherein the tubular includes a vale opening in the second screen housing, the beta blaster valve being arranged in the second screen housing at the valve opening.

Embodiment 4

The downhole system according to according to any previous embodiment, wherein the beta blaster valve includes an actuator feature responsive to flow in the conduit.

Embodiment 5

The downhole system according to according to any previous embodiment, wherein the beta blaster valve separates the second screen housing into a first volume and a second volume, the second volume being fluidically connected to the first screen system.

Embodiment 6

The downhole system according to according to any previous embodiment, further comprising: a duct extending from the second screen housing towards the first screen system.

Embodiment 7

The downhole system according to according to any previous embodiment, wherein the duct is directly fluidically connected to the first screen housing.

Embodiment 8

The downhole system according to according to any previous embodiment, further comprising: a biasing member arranged in the second volume, the biasing member urging the beta blaster valve to cover the valve opening.

Embodiment 9

The downhole system according to according to any previous embodiment, further comprising: a latch member selectively retaining the beta blaster valve in a closed configuration.

Embodiment 10

The downhole system according to according to any previous embodiment, further comprising: an inflow control device (ICD) arranged in the second screen housing.

Embodiment 11

The downhole system according to according to any previous embodiment, wherein the tubular is devoid of a wash pipe.

Embodiment 12

A method of gravel packing an open hole wellbore without a washpipe comprising: delivering a slurry into a tubular toward a toe of the open hole wellbore; generating a beta wave of the slurry; covering a first screen system with the beta wave; and opening a beta blaster valve arranged in a second screen system in response to the first screen system being covered.

Embodiment 13

The method according to any previous embodiment, further comprising: closing the beta blaster valve in response to the second screen system being covered.

Embodiment 14

The method according to any previous embodiment, further comprising: locking the beta blaster valve closed after the second screen system is covered.

Embodiment 15

The method according to any previous embodiment, further comprising: opening an inflow control device after the second screen system is covered and the beta blaster valve is closed.

Embodiment 16

The method according to any previous embodiment, wherein closing the beta blaster valve includes biasing the beta blaster valve towards a closed configuration with a biasing member.

Embodiment 17

The method according to any previous embodiment, wherein opening the beta blaster valve includes sensing a pressure differential between the first screen system and the second screen system.

Embodiment 18

The method according to any previous embodiment, wherein sensing the pressure differential includes covering an end of a duct extending from the second screen system.

Embodiment 19

The method according to any previous embodiment, wherein covering the end of the duct includes covering the covering the first screen system with slurry.

Embodiment 20

The method according to any previous embodiment, wherein opening the beta blaster valve includes locking the beta blaster valve in an open configuration.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole system comprising:

a tubular including an outer surface and an inner surface defining a conduit, the conduit being devoid of an additional tubular member and defining a fluid return path;

a terminal member connected to the tubular;

a first screen system including a first screen housing mounted to the tubular adjacent the terminal member; and a second screen system including a second screen housing mounted to the tubular and spaced from the first screen system, the second screen system including a beta blaster valve operable to selectively open flow into the conduit based on a pressure differential between the first screen system and the second screen system resulting from the first screen system being covered with a slurry while the second screen system remains uncovered.

2. The downhole system of claim 1, further comprising: a check valve arranged in the first screen housing between the first screen system and the terminal member.

3. The downhole system according to claim 1, wherein the tubular includes a vale opening in the second screen housing, the beta blaster valve being arranged in the second screen housing at the valve opening.

4. The downhole system according to claim 3, wherein the beta blaster valve includes an actuator feature responsive to flow in the conduit.

5. The downhole system according to claim 3, wherein the beta blaster valve separates the second screen housing into a first volume and a second volume, the second volume being fluidically connected to the first screen system.

6. The downhole system according to claim 5, further comprising: a duct extending from the second screen housing towards the first screen system.

7. The downhole system according to claim 6, wherein the duct is directly fluidically connected to the first screen housing.

8. The downhole system according to claim 5, further comprising: a biasing member arranged in the second volume, the biasing member urging the beta blaster valve to cover the valve opening.

9. The downhole system according to claim 5, further comprising: a latch member selectively retaining the beta blaster valve in a closed configuration.

10. The downhole system according to claim 9, further comprising: an inflow control device (ICD) arranged in the second screen housing.

11. A method of gravel packing an open hole wellbore with a tubular including a conduit that is devoid of any additional tubulars comprising:

delivering a slurry between an annular wall of the wellbore and the tubular toward a toe of the open hole wellbore;

generating a beta wave of the slurry;

covering a first screen system with the beta wave; and opening a beta blaster valve arranged in a second screen system in response to a pressure drop below the second screen system when the first screen system is covered and before the second screen is covered; and accepting return fluid into the conduit through the beta blaster valve.

12. The method of claim 11, further comprising: closing the beta blaster valve in response to the second screen system being covered.

13. The method of claim 12, further comprising: locking the beta blaster valve closed after the second screen system is covered.

14. The method of claim 12, further comprising: opening an inflow control device after the second screen system is covered and the beta blaster valve is closed.

15. The method of claim 11, wherein closing the beta blaster valve includes biasing the beta blaster valve towards a closed configuration with a biasing member.

16. The method of claim 11, wherein opening the beta blaster valve includes sensing a pressure differential between the first screen system and the second screen system.

17. The method of claim 16, wherein sensing the pressure differential includes covering an end of a duct extending from the second screen system.

18. The method of claim 17, wherein covering the end of the duct includes covering the covering the first screen system with slurry.

19. The method of claim 11, wherein opening the beta blaster valve includes locking the beta blaster valve in an open configuration.

* * * * *